US005929894A

United States Patent [19]

Kikuchi

[11] Patent Number: 5,929,894

[45] Date of Patent: Jul. 27, 1999

[54] CONTINUOUS FORM PRINTER

[75] Inventor: Shinji Kikuchi, Tokyo, Japan

[73] Assignee: Asahi Kogaku Kogyo Kabushiki Kaisha, Tokyo, Japan

[21] Appl. No.: 08/903,003

[22] Filed: Jul. 30, 1997

[30] Foreign Application Priority Data

Aug. 1, 1996 [JP] Japan ..... 8-219431

[51] Int. Cl.[6] ..... B41J 11/42

[52] U.S. Cl. ..... 347/262; 347/264; 400/582; 400/583; 399/384

[58] Field of Search ..... 347/262, 247, 347/263, 264; 399/384; 400/582, 583

[56] References Cited

U.S. PATENT DOCUMENTS 4,912,490 3/1990 Negoro et al. ..... 347/139
4,949,104 8/1990 Negoro et al. ..... 347/139
5,194,903 3/1993 Negishi et al. ..... 399/384
5,194,970 3/1993 Iwanade ..... 358/498
5,210,583 5/1993 Monma ..... 399/384
5,564,845 10/1996 Yamaguchi et al. ..... 400/582

*Primary Examiner*—N. Le
*Assistant Examiner*—Hai C. Pham
*Attorney, Agent, or Firm*—Greenblum & Bernstein P.L.C.

[57] ABSTRACT

In a continuous form printer, a passage of the leading edge of the continuous form sheet is detected by a top sensor located along a feeding path thereof. A system determines whether the detection of the leading edge by the top sensor is correct, by comparing the feeding amount of the continuous form sheet after the feeding is started until the leading edge is detected with the distance between a feeding start position and the top sensor.

26 Claims, 8 Drawing Sheets

START PROCESS
S101
TOP SENSOR ON?
YES
NO
S102
TRACTOR MOTOR FORWARD ROTATION
S103
TOP SENSOR ON?
NO
YES
1
SET C1 IN COUNTERA
S104
TRACTOR MOTOR REVISED ROTATION
S106
DECREMENT COUNTER A FOR EACH FEED PULSE
S108
S110
COUNTER A=0?
YES
NO
S116
TRACTOR MOTOR STOP
PRINT PROCESS
S118
S112
TOP SENSOR OFF?
NO
YES
TRACTOR MOTOR STOP
S113
SUBSTRACT THE VALUE OF COUNTER A FROM C1
S114
S120
D>D1-ΔW?
NO
YES
S122
D<D1+ΔW?
YES
NO
1

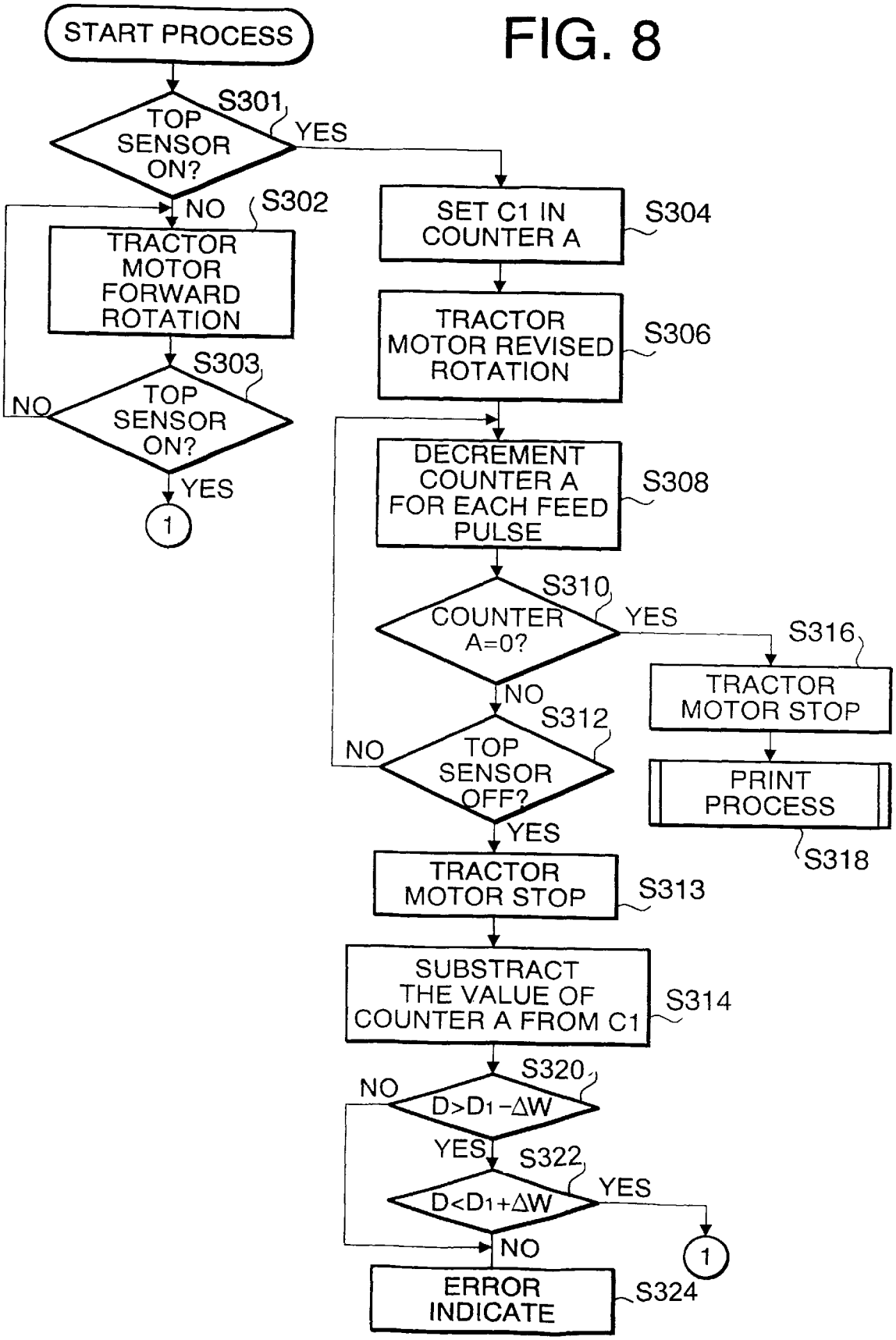
FIG. 8
START PROCESS
S301
TOP SENSOR ON?
YES
NO
S302
TRACTOR MOTOR FORWARD ROTATION
S303
TOP SENSOR ON?
NO
YES
1
SET C1 IN COUNTER A
S304
TRACTOR MOTOR REVISED ROTATION
S306
DECREMENT COUNTER A FOR EACH FEED PULSE
S308
S310
COUNTER A=0?
YES
NO
S316
TRACTOR MOTOR STOP
PRINT PROCESS
S318
S312
TOP SENSOR OFF?
NO
YES
TRACTOR MOTOR STOP
S313
SUBSTRACT THE VALUE OF COUNTER A FROM C1
S314
S320
D>D1−ΔW
NO
YES
S322
D<D1+ΔW
YES
NO
1
ERROR INDICATE
S324

CONTINUOUS FORM PRINTER

BACKGROUND OF THE INVENTION

The present invention relates to a continuous form printer using a continuous form sheet.

In general, a continuous form printer includes a tractor unit having a pair of tractor belts and pulleys for driving the tractor belts. Each tractor belt is provided with protrusions for engaging with feed holes formed at a predetermined pitch at the sides of the continuous form sheet.

In order to, detect a leading edge of the continuous form sheet after the continuous form sheet is set in the tractor unit or after the printer is turned on, a top sensor is provided downstream of the tractor unit in the feeding direction of the continuous form sheet. A conventional top sensor includes a swingable lever swingable between an erect position where the swingable lever projects across the feeding path of the continuous form sheet, and a retracted position where the swingable lever does not project into the feeding path. When a continuous form sheet is present at the position of the swingable lever, the swingable lever is pressed down by the continuous form sheet below the feeding path. The top sensor further includes a detecting sensor for detecting the position of the swingable lever. In general, the detecting sensor is arranged to generate an OFF signal when the swingable lever is in the erect position and to generate an ON signal when the swingable lever is in the retracted position. The passage of the leading edge of the continuous form sheet can be detected in response to a change in the signal from the detecting sensor.

However, there is a possibility that the continuous form sheet may bend or be warped, causing a portion of the continuous form sheet to be deflected upward. In this case, if the portion of the continuous form sheet deflected upward is above the swingable lever of the top sensor, the swingable lever may not be pressed down by the continuous form sheet even though the continuous form sheet, is present. Consequently, the detecting sensor may incorrectly send an OFF signal even though the continuous form sheet is correctly positioned. In such a case, a control unit of the printer may mistakenly determine a leading edge of the continuous form sheet, which causes a deviation of the printing position on the continuous form sheet.

More particularly, a recently proposed printer is arranged to discharge a printed page of the continuous form sheet out of the printer so that a user may check the result of the printing or may separate a page from the continuous form sheet. In such a printer, since a user touches the discharged sheet for checking or separating, the chance of the continuous form sheet being bent (or warped) and deflected is increased. Thus, the above-mentioned incorrect detection of the leading edge and resulting incorrect printing may occur more often.

SUMMARY OF THE INVENTION

It is therefore an object of the present invention to provide a continuous form printer in which an incorrect detection of the leading edge of the continuous form sheet is prevented.

For this purpose, according to one aspect of the present invention, there is provided a continuous form printer including a tractor unit capable of feeding the continuous form sheet in first and second directions, a top sensor which detects a leading edge of the continuous form sheet fed by the tractor unit, and a discriminating system which discriminates whether the detection of the leading edge by the top sensor is correct. The printer is arranged to print images on the continuous form sheet when the tractor unit feeds the continuous form sheet in the first direction. The printer is further arranged to retract the continuous form sheet in the second direction prior to printing. Retraction begins when a border line (such as perforations) of pages of the continuous form sheet is located at a predetermined position. If the top sensor detects the leading edge during retraction, the discriminating system compares a first value corresponding to a feeding amount of the continuous form sheet after retraction begins until the leading a edge is detected with a second value corresponding to a distance between the predetermined position and the top sensor.

As above constructed, if the first value (feeding amount) differs from the second value (distance between the predetermined position and the top sensor), it is determined that the detection of the leading edge of the continuous form sheet by the top sensor is erroneous. Conversely, if there is no difference between the first and second values, it is determined that the detection of the leading edge by the top sensor is correct. Thus, the incorrect detection of the leading edge is prevented.

In a particular arrangement, the tractor unit feeds the continuous form sheet in the first direction to discharge a printed portion of the continuous form sheet out of the printer upon completion of printing. In this case, the predetermined position is positioned outside of the printer. Further, the top sensor is located downstream of the tractor unit in the first direction.

In another particular arrangement, a feed, pulse generator is provided for generating a feed pulse responsive to a predetermined interval of feeding of the paper. In this case, the above comparison can be done by counting the feed pulses. Particularly, the first value is obtained by counting the feed pulses after extraction starts until the leading edge is detected. Further, the second value is a predetermined value which has been set to a number of the feed pulses corresponding to the distance between the predetermined position and the top sensor.

Optionally, that the discriminating system checks that a the detection is correct when a difference between the first and second values is not within a predetermined range.

Further, it is preferable to continue retraction when the discriminating system determines that the detection of the leading edge is not correct. Alternatively, it is possible to terminate the retraction when the discriminating system determines that the detection of the leading edge is not correct.

Furthermore, the top sensor includes a swingable lever swingable between an erect position in which the swingable lever projects a sheet feeding path of the sheet, and a retracted position in which the swingable lever is retracted from the erect position, and a detecting sensor which detects the position of the swingable lever.

According to another aspect of the present invention, there is provided a feeding system including a tractor unit which feeds the continuous form sheet, a top sensor which detects a leading edge of the continuous form sheet fed by the tractor unit, and a discriminating system which discriminates whether the detection of the top sensor is correct. The printer performs a predetermined feeding process. The feeding process is started when a border line of pages of the continuous form is located at a predetermined position. If the top sensor detects the leading edge during the feeding process, the discriminating system compares a first value corresponding to a feeding amount of the continuous form sheet after the feeding process is started until the leading edge is detected with a second value corresponding to a distance between the predetermined position and the top sensor.

BRIEF DESCRIPTION OF THE DRAWINGS

FIG. 8 is a flowchart of a print start process according to an alternative arrangement of the embodiment.

DESCRIPTION OF THE EMBODIMENTS

Figure 1:
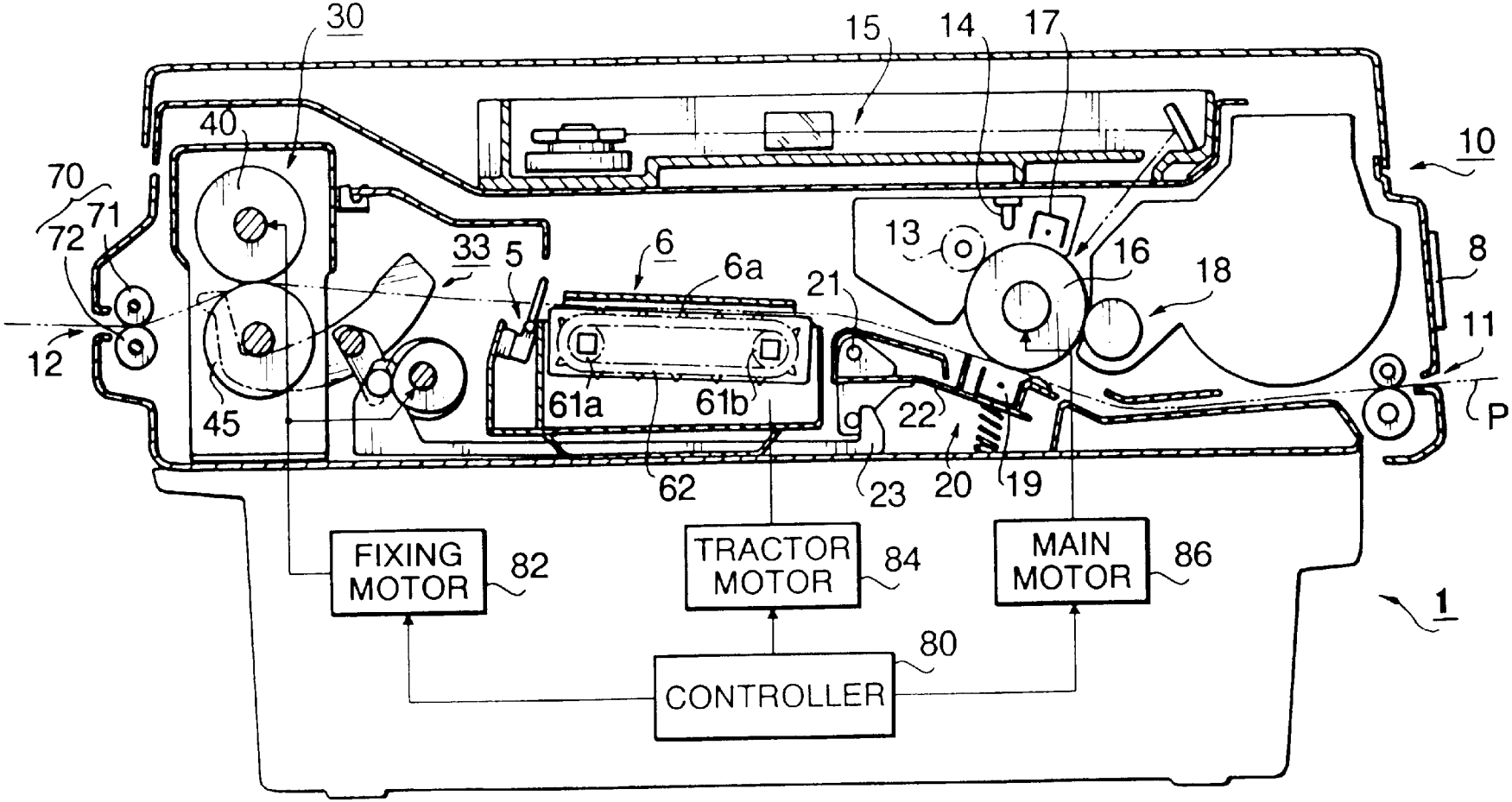
FIG. 1 is a side view of a printer according to an embodiment of the invention.

An embodiment of the present invention is described with reference to the accompanying drawings. FIG. 1 shows a continuous form printer 1 arranged to print images on a continuous-form sheet P (hereinafter a sheet P) using electrophotographic technology. The continuous form sheet P has a discrete page length defined by perforations between pages.

The printer 1 includes a laser scanning unit 15 for emitting a laser beam, a photoconductive drum 16 on which a latent image is formed by the laser beam emitted from the: laser scanning unit 15, a developing unit 18 for applying toner to the latent image formed on the drum 16, a transfer unit 20 for transferring a toner image from the drum 16 onto a sheet P, and a fixing unit 30 for fixing the toner image on the sheet P. All of these are accommodated in a housing 10.

The printer 1 further includes a cleaning unit 13 for removing residual toner on the drum 16, a discharge unit 14 for discharging the surface of the drum 16, and a charging unit 17 for uniformly charging the surface of the drum 16.

The sheet P enters into the housing 10 from a sheet inlet 11 provided at one side of the housing 10. In the housing 10, the sheet P passes through the transfer unit 20 and fixing unit 30 along a predetermined feeding path. Then, the sheet P is discharged from the housing 10 from a sheet outlet 12 provided at the other side of the housing 10. A feeding of the sheet P in the housing 10 is performed by a tractor unit 6 (detailed below) provided between the transfer unit 20 and the fixing unit 30. Further, the printer 1 includes a discharge roller unit 70 provided between the fixing unit 30 and the sheet outlet 12, for discharging the sheet P.

A controller 80 controls a tractor motor 84 for driving the tractor unit 20, a fixing motor 82 (described below) for driving the fixing unit 30, and a main motor 86 for rotating the drum 16.

A printing process is carried out in the following manner. A laser beam is emitted from the laser scanning unit 15 and directed to a circumferential surface of the drum 16. The drum 16 has been uniformly charged in advance by the charging unit 17. When the drum 16 is exposed by the modulated laser beam, a latent image is formed thereon. At the developing unit 18, toner is applied to the latent image formed on the drum 16, and a toner image is thus formed on the drum 16. The toner image is transferred onto the sheet P at a corona charger 19 provided in the transfer unit 20. The toner image transferred onto the sheet P is fixed on the sheet P by the application of pressure and heat at the fixing unit 30. As the drum 16 rotates, any residual toner remaining on the drum 16 is removed by the cleaning unit 13. Drum 16 is discharged by the discharge unit 14 to prepare for the next printing.

The fixing unit 30 includes a heat roller 40 accommodating a heat source therein and a press roller 45 having a surface made of an elastic member. The heat roller 40 is driven by the fixing motor 82.

Although the sheet P is in contact with the heat roller 40, pressure roller 45 and discharge rollers 70 during printing, the feeding speed is determined by the tractor unit 6. Further, in order to give tension to a portion of the sheet P between the fixing unit 30 and the tractor unit 6, when the sheet P is fed in a forward direction, the circumferential speed of the heat roller 40 is set to be slightly faster than the feeding speed of the sheet P by the tractor unit 6. This tension is applied to help prevent the sheet P from undesirably bending or curving.

The fixing unit 30 is provided with an opening/closing mechanism 33 for opening and closing the heat roller 40 and the press roller 45. The opening/closing mechanism 33 moves the press roller 45 between an operating position where the sheet P is pressed between the press roller 45 and the heat roller 40, and a retracted position where the press roller 45 is retracted from the operating position.

In the transfer unit 20, the corona charger 19 is supported by a swingable holder 22 swingably provided around a swing axis 21 so as to be movable between an operating position adjacent to the surface of the drum 16 and a retracted position away from the drum 16. The swingable holder 22 is swung by a slide arm 23 which, linked with the opening/closing mechanism 33, slides to the right and to the left in the view of FIG. 1. Further, a discharge roller unit 70 includes an upper roller 71 and a lower roller 72 disposed above and below the sheet P, respectively. The upper roller 71 is linked with the opening/closing mechanism 33 via not shown mechanism and moves between an operating position where the sheet P is sandwiched between the upper roller 71 and the lower roller 72 and a retracted position where the upper roller 71 is retracted from the operating position.

The printer 1 is arranged to discharge a printed page of the sheet P so that a user may check or separate the printed page, and to retract the sheet P when the next printing is started. When the sheet P is being fed in reverse or is stopped, the press roller 45, the corona charger 19, and the upper roller 71 are moved to their retracted positions by the opening/closing mechanism 33, to thereby release the sheet P for easy movement along the feeding path.

Figure 2:
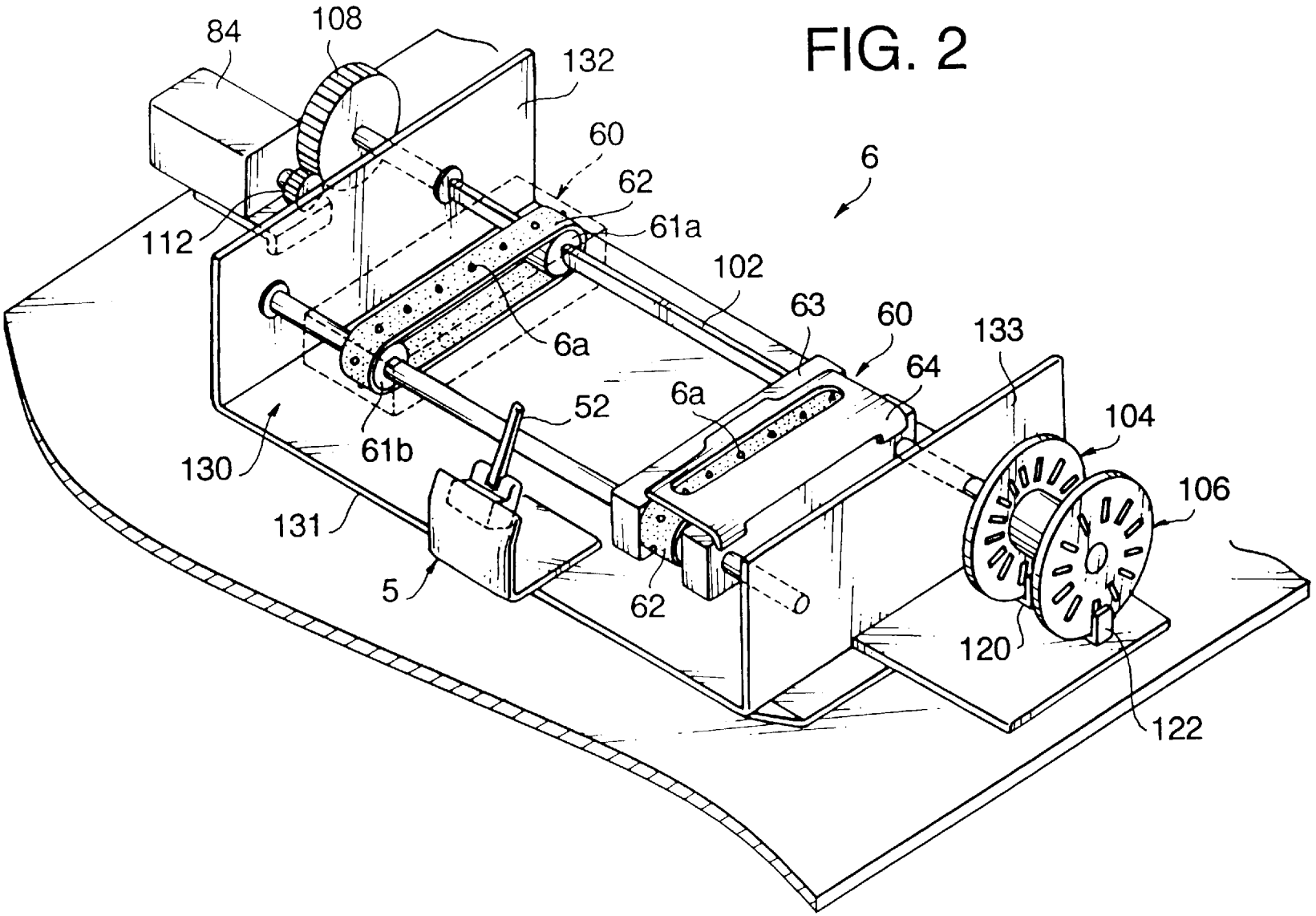
FIG. 2 is a perspective view of a tractor unit of the printer of FIG. 1.

The construction of the tractor unit 6 is now described. FIG. 2 is a perspective view of the tractor unit 6. The tractor unit. 6 includes a U-shaped unit frame 130 and the two tractors 60. The unit frame 130 includes a bottom plate 131 secured to the housing 10, and a pair of side plates 132 and 133.

Each tractor 60 includes the tractor belt 62 and the pulleys 61*a* and 61*b* for driving the tractor belt 62. The tractor belt 62 and the pulleys 61*a* and 61*b* are rotatably supported in a support frame 63. In FIG. 2, the support frame 63 on the left side is shown by dotted lines in order to show the pulleys 61*a* and 61*b* and the tractor belt 62 accommodated therein.

Each support frame 63 is provided with a swinging cover 64 to cover the upper side of the tractor belts 62 thereby to maintain the engagement of the feed holes of the sheet and the protrusions 6*a* of the tractor belts 62. To set the sheet in the tractors 60, the swinging covers 64 are swung up to open the upper side of the tractor belts 62. Then, after the feed holes of the sheet are fit to the protrusions 6*a* of the tractor belts 62, the swinging covers 64 are closed to hold the sheet to the tractor belts 62.

A drive shaft 102 is provided for driving the pulleys 61*a*, which extends through the driving pulleys 61*a* and outwardly at the left side plate 132 and at the right side plate 133, respectively. The drive shaft 102 is provided with a slave gear 108, at the left end (in the view of FIG. 2) of the drive shaft 102, which is driven by the tractor motor 84 via a driving gear 112. The tractor motor 84 is mounted on the left side plate 132.

Further, the drive shaft 102 is provided, at the right end thereof, with encoder wheels 104 and 106 for outputting feed pulses indicating feeding, of the sheet by a predetermined amount. A rotation of the encoder wheels 104 and 106 is sensed by photo-sensors 120 and 122, respectively. The control unit 80 (FIG. 1) selects one or both of the encoder sensors 120, 122 according to a page length input through a control panel 8 (FIG. 1) to control the feeding of the sheet based on the feed pulses output from a corresponding one of the encoder sensors 120, 122.

Figure 3:
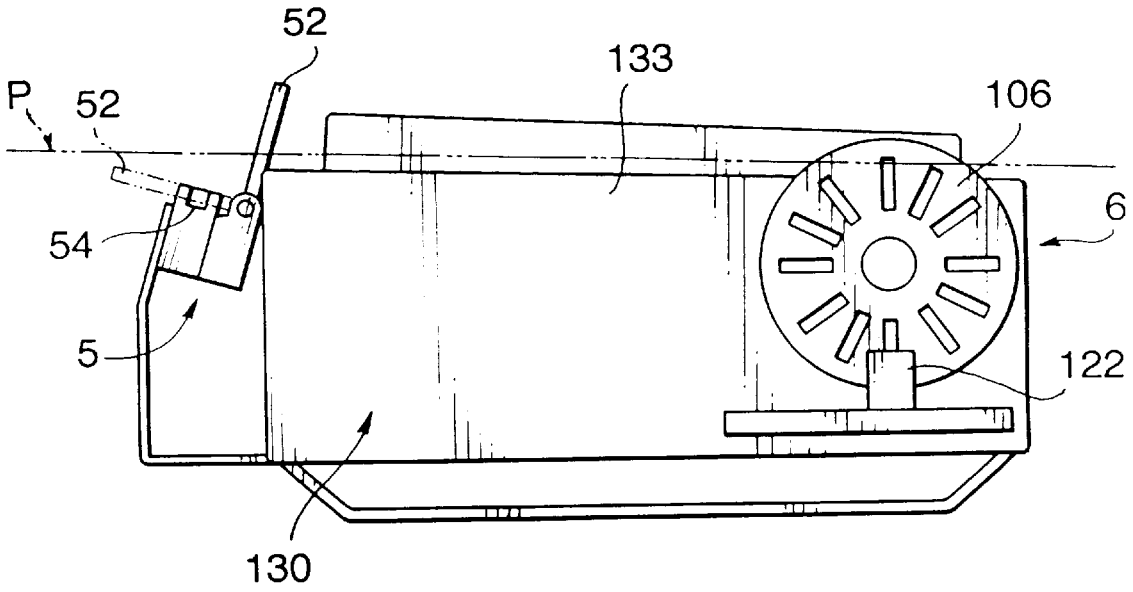
FIG. 3 is a side view of the tractor unit of FIG. 2.

A top sensor 5 is now described. FIG. 3 is a right side view of the tractor unit 6. The top sensor 5 includes a swingable lever 52 swingable between an erect position (shown by a solid line) and a retracted position (shown by a dotted line). When the swingable lever 52 is in the erect P2 position, the swingable lever 52 projects across the feeding path of the sheet P. The swingable lever 52 is biased upward by means of a torsion spring (not shown). The top sensor 5 further includes a detecting sensor 54 which is a photo sensor for detecting the swingable lever 52. The detecting sensor 54 is constructed to generate an OFF signal when the swingable lever 52 is in the erect position and to generate an ON signal when the swingable lever 52 is in the retracted position.

Figure 4:
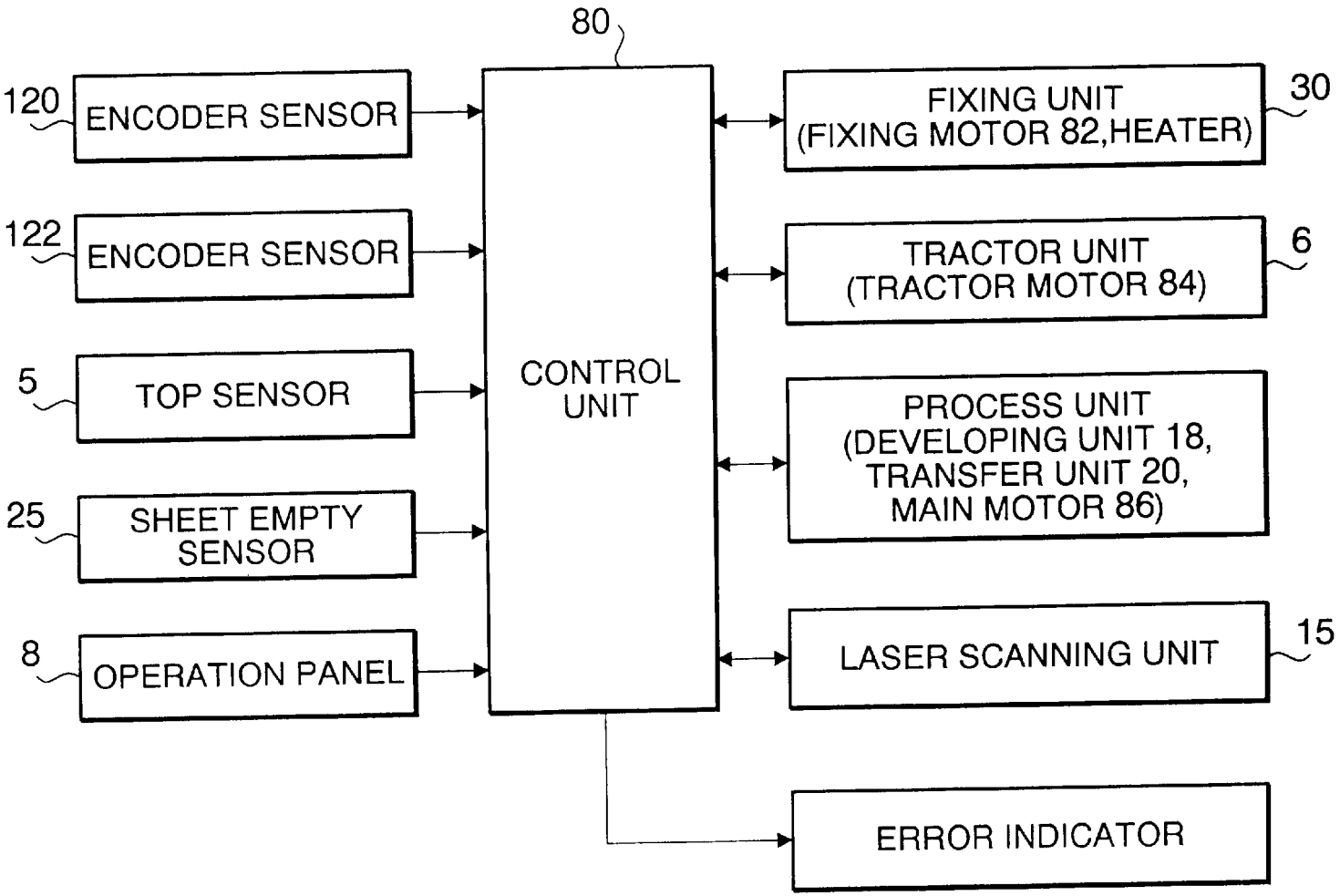
FIG. 4 is a block diagram of the printer shown in FIG. 1.

FIG. 4 is a block diagram of the printer 1. The control unit 80 receives signals from the operation panel 8, the top sensor 5, the encoder sensors 120, 122, and a sheet empty sensor 25. According to the signals received, the control unit 80 controls the tractor unit 6, the fixing unit 30 (including the fixing motor 82 and the heat source), the laser scanning unit 15, and a process unit (including the developing unit 18, the transferring unit 20, the main motor 86, and the like).

Figure 5:
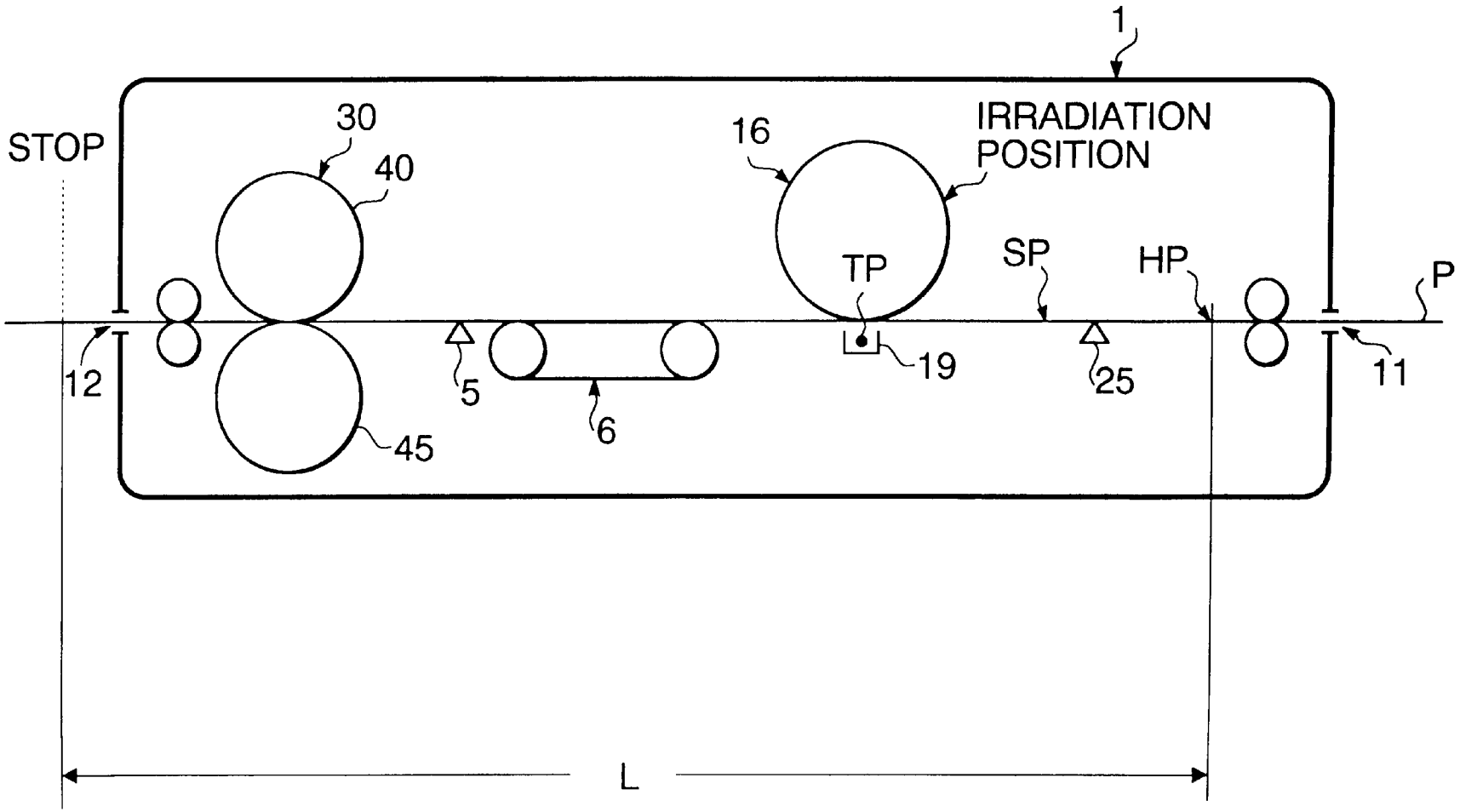
FIG. 5 is an explanatory view indicating positional relationships among each of the elements of the printer.

FIG. 5 is an explanatory view indicating positional relationships among each of the elements of the printer 1. In FIG. 5, the circumferential position on the drum 16 at which the laser beam from the laser scanning unit 15 reaches the drum 16 is designated an "irradiation position". Further, various positions are defined on the feeding path of the sheet P. A transfer position TP is defined as the position on the feeding path at which the toner image is transferred to the sheet P. A synchronous position SP is defined as a position on the feeding path that is upstream from the transferring position TP by a distance equal to the distance about the circumference of drum 16 from the transfer position TP to the irradiation position. A home position HP is defined as a position that is a predetermined distance upstream from the synchronous position SP. The home position HP represents the position at which leading edge of the sheet P is to be positioned when the printing is to be started. When the perforations between pages reach the synchronous position SP, an exposure operation (i.e., scanning by the laser scanning unit 15) is started. Further, a stop position STOP is defined as a position a predetermined distance outside of the sheet outlet 12. As shown in FIG. 5, there is a distance "L" between the stop position STOP and the home position HP. In this embodiment, the page length is greater than the distance between the top sensor 5 and the home position HP.

When power is supplied to the printer 1, various checks are first performed. For example, a memory check for ROM (read only memory) (not shown) and RAM (random access memory) (not shown) in the control unit 80, an operation check for the laser scanning unit 15, a toner check for the developing unit 18, a sheet check by the paper empty sensor 25 to determine if a sheet P is loaded, and the like. Then, heating of the heat roller 40 of the fixing unit 30 starts to prepare the printing operation.

Figure 6:
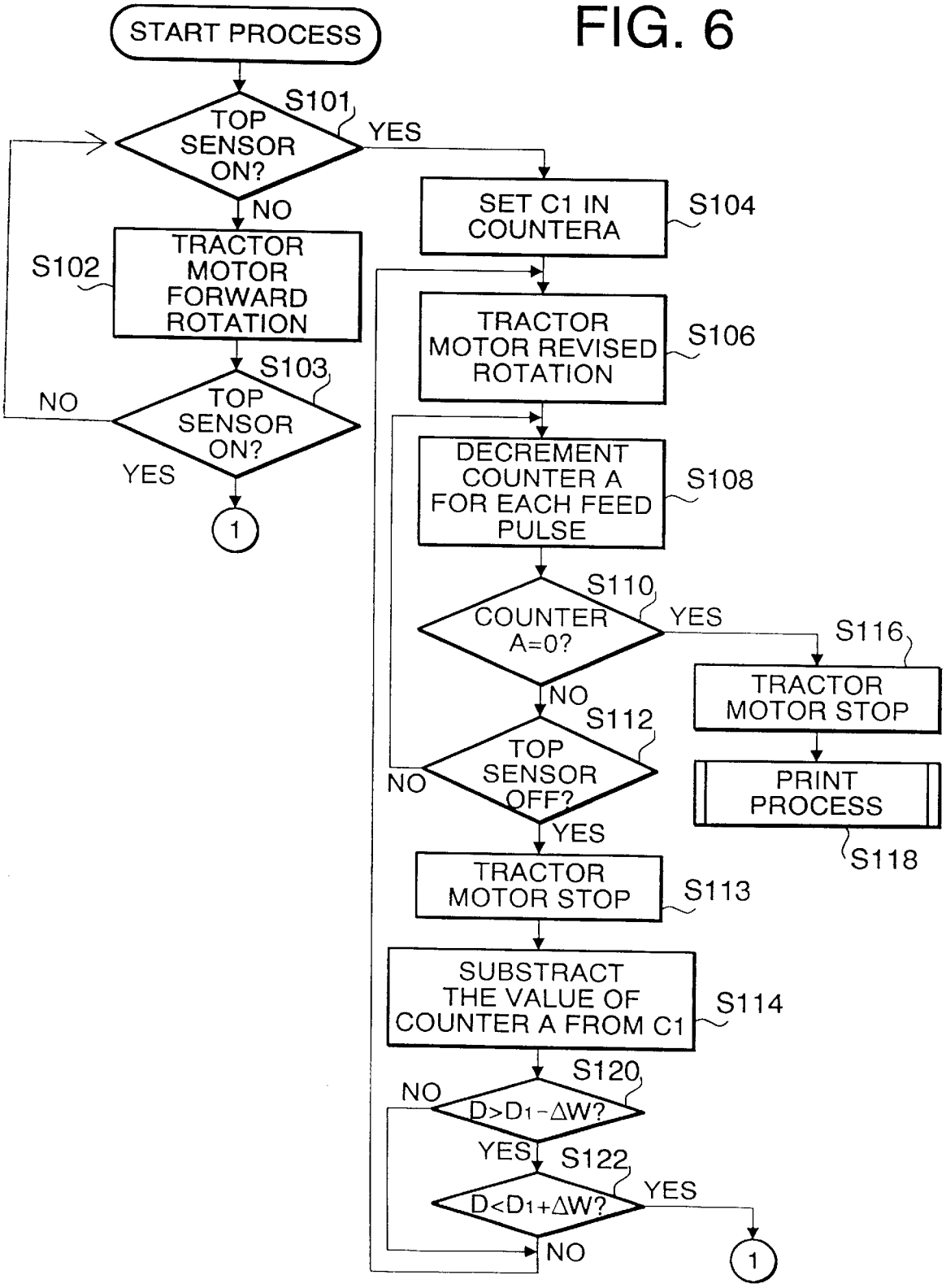
FIGS. 6 and 7 are flowcharts of a print start process of the embodiment.
Figure 7:
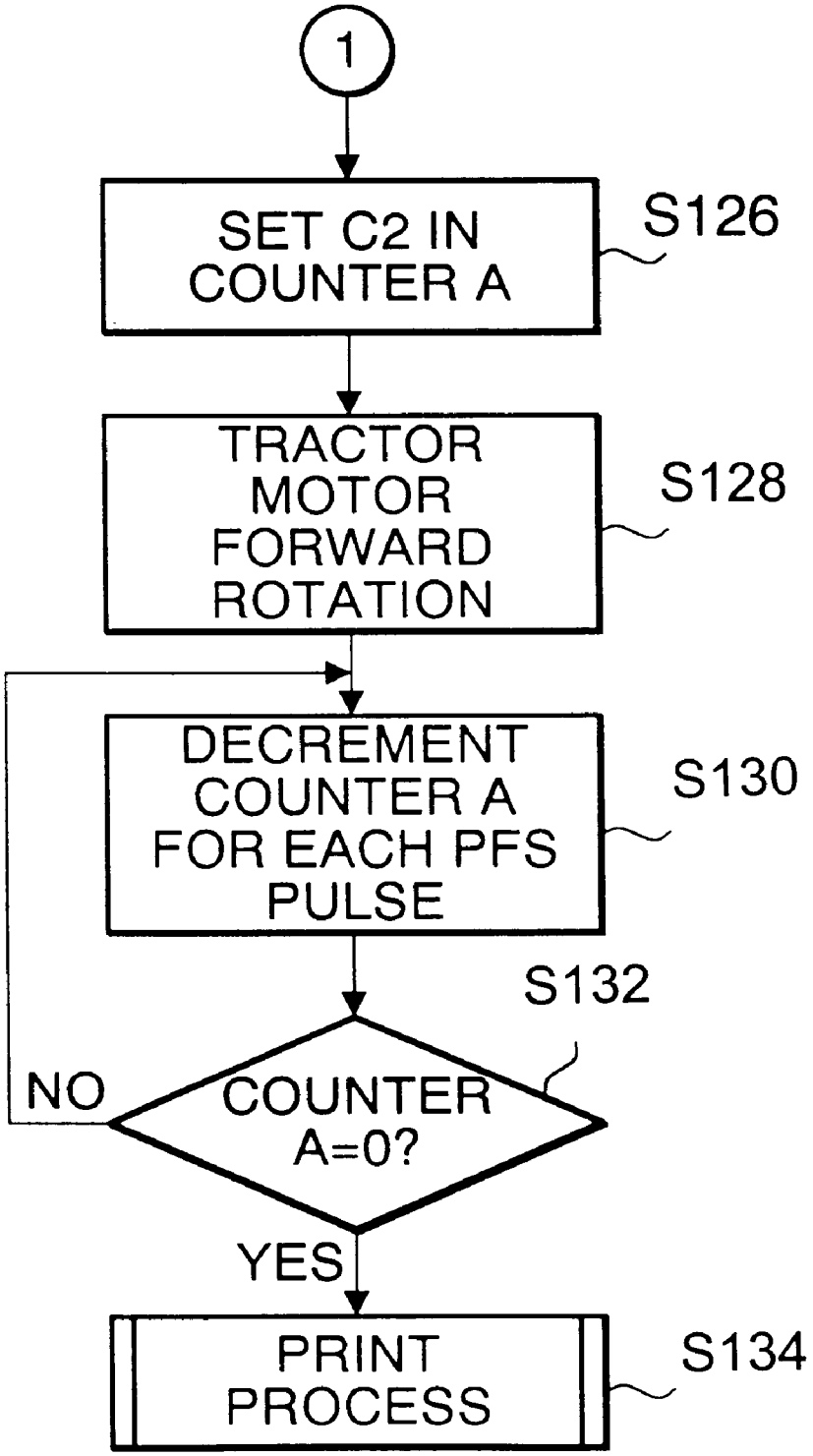

FIGS. 6 and 7 show flowcharts of a print start process. The print start process is performed when a print request is received from a computer (not shown) or the like First, the control unit 80 checks whether the top sensor 5 is ON at step S101 (that is, whether the lever 52 is pressed downward to the retracted position by the presence of the sheet). If the top sensor 5 is OFF (NO at S101), the sheet might have just been set in the printer 1 and therefore, the leading edge thereof has not yet reached the top sensor 5. Accordingly, in S102 and. S103, the sheet is fed forward until the top sensor 5 is detected as ON (that is, until the leading edge of the sheet reaches the top sensor 5). Then, in steps S126 through S134 (described below with reference to FIG. 7), a top-set process is carried out, in which a first page of the sheet remains on the tractor unit 6 and leading perforations of a second page are located at the home position HP.

If the top sensor 5 is ON (YES at S101), it indicates that the trailing perforations of the last printed page are located at the stop position STOP because of the previous print process. In this state, a user may have checked the last printed page, and may have separated the page by tearing along the trailing perforations of the last printed page.

If the last printed page has not been separated, the control unit 80 controls the tractor unit 6 to locate the trailing perforations of the last printed page at the home position HP. Conversely, if the last printed page has been separated from the sheet, the control unit 80 controls the tractor unit 6 to locate the trailing perforation of the next page following the last printed page (hereinafter the first page following) at the home position HP, since the first page following must remain on the tractor unit 6 for enabling the feeding of the sheet P.

Thus, in step S104, a number of feed pulses "C1" corresponding to the distance "L" is set in a counter A. In step S106, the tractor motor 84 is rotated in reverse, decrementing the counter A by one for each feed pulse (in step S108). The control unit 80 checks if the counter A has reached zero until the top sensor 5 turns OFF at steps S110 and S112.

If the counter A reaches zero before the top sensor 5 turns OFF (Yes at step S110), it indicates that the last printed page has not been separated from the sheet and that the leading perforations of the first page following are located at the home position HP. Then, the control unit 80 stops the feeding of the sheet and a print process can be performed (steps S116 and S118). Conversely, if the top sensor 5 turns OFF before the counter A reaches zero at steps S110 and S112, it indicates that the last printed page has been separated from the sheet (Yes at step S112). Then, the control stops the tractor motor 84 (at step S113) and discriminates whether the detection of the leading edge by the top sensor 5 is correct or not (at steps S114, S120 and S122). This discriminating is done by comparing the reverse feeding amount in steps S104 through S112 with the distance between the stop position STOP and the top sensor 5. If the difference between both values is not within a predetermined range, the control unit 80 determines that the detection of the leading edge by the top sensor 5 is not correct. In this embodiment, the predetermined range is set at ½ inch.

For this purpose, at step S114, the value in the counter A is subtracted from C1 to obtain value "D" which corresponds to the reverse feeding amount in steps S104 through S112. Then, it is determined whether the value "D" satisfies the condition (at steps S120 and S122):

$$D1-\Delta w<D<D1+\Delta w \ldots \quad (1)$$

where D1 is the number of feed pulses corresponding to the distance between the top sensor 5 and the stop position STOP, and Δw is a half of the predetermined range.

If the condition (1) is not satisfied (NO at step S120 or S122), it is determined that the detection of the leading edge by the top sensor 5 is not correct. That is, the leading edge of the sheet P has not yet reached the tops sensor 5. Thus, the processing returns to step S106 to further continue the reverse feeding of the sheet.

Conversely, if the condition (1) is satisfied (YES at steps S120 and S122), it is determined that the detection of the leading edge by the top sensor 5 is correct. In this case, a leading edge of the sheet P is located at the top sensor 5 and the trailing perforations of the first page following (leading perforations of the second page, following) are positioned upstream of the home position HP. Accordingly, the top-set process of steps S126 to S132 is performed and the sheet is fed forward to position the trailing perforations of the first page following (the leading perforations of the second page following) at the home position HP.

As shown in FIG. 7, in step S126, a number of feed pulses "C2", corresponding to a distance between the home position HP and the leading perforation of the second page following when the leading edge of the sheet P is located at the top sensor 5, is set in the counter A. Then, at step S128, the tractor motor 84 is rotated forward to fed the sheet forward until the counter A reaches zero (steps S130, S132). When the leading perforations of the second page following have reached the home position HP, it is possible to perform the print process (step S134). Since the print process is the same as that in a conventional printer, an explanation thereof is omitted.

As described above, the printer 1 is designed to discriminate whether detection of the leading edge of the sheet by the top sensor is correct or not, by comparing the amount of reverse feeding of the sheet with the distance between the stop position STOP and the top sensor 5. Thus, a misdetection of the leading edge of the sheet is prevented. Accordingly, the displacement of the printing position caused by the misdetection of the leading edge can be avoided.

FIG. 8 shows an alternative arrangement of the print start process. In the print start process of FIG. 8, the steps S301 through S322 are the same as the steps S101 through S122 in FIG. 6. In the print start process of FIG. 8, if a misdetection of the leading edge is found at steps S320 and S322, an error indicator (FIG. 4) is turned on (S324), instead of continuing the reverse feeding of the sheet P as in FIG. 6.

Although the structure and operation of a printer and a feeding system thereof are described herein with respect to the preferred embodiments, many modifications and changes can be made without departing from the spirit and scope of the invention.

The present disclosure relates to subject matter contained in Japanese Patent Application No. HEI 08-219431 filed on Aug. 1, 1996 which is expressly incorporated herein by reference in its entirety.

What is claimed is:

1. A printer for printing images on a continuous form sheet, said printer comprising:

a tractor unit which feeds said continuous form sheet in first and second directions;

a top sensor which detects a leading edge of said continuous form sheet fed by said tractor unit;

a discriminating system which determines whether the detection of said leading edge by said top sensor is correct responsive to an actual detection of said leading edge of said sheet, or incorrect responsive to an imperfection in said sheet at a location other than said leading edge of said sheet which causes said top sensor to incorrectly indicate the presence of said leading edge of said sheet;

said printer printing images on said continuous form sheet when said tractor unit feeds said continuous form sheet in said first direction; and said printer further retracting said continuous form sheet in said second direction prior to said printing, said retraction being started when a border line of pages of said continuous form sheet is located at a predetermined position, wherein, when said top sensor detects said leading edge during retraction, said discriminating system compares a first value, corresponding to a feeding amount of said continuous form sheet after retraction is started until said leading edge is detected, with a second value, corresponding to a distance between said predetermined position and said top sensor.

2. The printer according to claim 1, wherein said tractor unit feeds said continuous form sheet in said first direction to discharge a printed portion of said continuous form sheet out of said printer upon completion of printing.

3. The printer according to claim 2, wherein said predetermined position is positioned outside of said printer.

4. The printer according to claim 1, wherein said top sensor is located downstream of said tractor unit in said first direction.

5. The printer according to claim 1, further comprising a feed pulse generator for generating a feed pulse responsive to a predetermined interval of feeding of said continuous foam sheet, wherein said discriminating system counts said feed pulses to compare said first and second values.

6. The printer according to claim 5, wherein said first value is obtained by counting said feed pulses after retraction is started until said leading edge is detected.

7. The printer according to claim 5, wherein said second value is a number of said feed pulses corresponding to the distance between said predetermined position and said top sensor.

8. The printer according to claim 1, wherein said et discriminating system determines that said detection is correct when a difference between said first and second value is not within a predetermined range.

9. The printer according to claim 1, wherein, when said discriminating system determines that the detection of said leading edge is not correct, retraction continues.

10. The printer according to claim 1, wherein, when said discriminating system determines that the detection of said leading edge is not correct, retraction is terminated.

11. The printer according to claim 1, wherein said top sensor comprises:

a swingable lever swingable between an erect position in which said swingable lever projects across a sheet feeding path of said continuous form sheet, and a retracted position in which said swingable lever is retracted from said erect position; and a sensor which detects the position of said swingable lever.

12. The printer according to claim 11, wherein said top sensor is arranged to output a first signal indicating that said lever member is in said erect position and a second signal indicating that said lever member is in said retracted position.

13. The printer according to claim 1, wherein said continuous form sheet has feed holes at a predetermined pitch on both sides thereof, said tractor unit further comprising a pair of tractor belts with projections engaging said feed holes of said continuous form sheet.

14. The printer according to claim 13, wherein said tractor unit further comprises driving pulleys for driving said tractor belts, said driving pulleys being provided with an encoder at a driving shaft thereof.

15. The printer according to claim 14, wherein said encoder generates feed pulses responsive to a predetermined interval of feeding of said continuous form sheet.

16. A feeding system for feeding a continuous form sheet, comprising:

a tractor unit which feeds said continuous form sheet;

a top sensor which detects a leading edge of said continuous form sheet fed by said tractor unit;

a discriminating system which determines whether the detection of said top sensor is correct responsive to an actual detection of said leading edge of said sheet or incorrect responsive to an imperfection in said sheet at a location other than said leading edge of said sheet which causes said top sensor to incorrectly indicate a presence of said leading edge of said sheet; and said feeding system performing a predetermined feeding process, said feeding process being started when a border line of pages of said continuous form is located at a predetermined position, wherein when top sensor detects said leading edge during said feeding process, said discriminating system compares a first value corresponding to a feeding amount of said continuous form sheet after said feeding process is started until said leading edge is detected with a second value corresponding to a distance between said predetermined position and said top sensor.

17. The feeding system according to claim 16, further comprising a feed pulse generator for generating a feed pulse responsive to a predetermined interval of feeding of said continuous form sheet, wherein said discriminating system compares said first and second values by counting said feed pulses.

18. The feeding system according to claim 17, wherein said first value is obtained by counting said feed pulses after said feeding process is started until said leading edge is detected.

19. The feeding system according to claim 18, wherein said second value is a number of said feed pulses corresponding to the distance between said predetermined position and said top sensor.

20. The feeding system according to claim 16, wherein said discriminating system determines that said detection is correct when a difference between said first and second values is within a predetermined range.

21. A feeding system according to claim 20, wherein said predetermined range represents less than a full page length of said continuous form sheet.

22. A feeding system according to claim 20, wherein said predetermined range represents half an inch of page length of said continuous form sheet.

23. The feeding system according to claim 16, wherein said feeding process continues when said discriminating system determines that the detection of said leading edge is not correct.

24. The feeding system according to claim 16, wherein said feeding process is terminated when said discriminating system determines that the detection of said leading edge is not correct.

25. The feeding system according to claim 16, wherein said top sensor comprises:

a swingable lever swingable between an erect position in which said swingable lever projects across a sheet feeding path of said continuous form sheet and a retracted position in which said swingable lever is retracted from said erect position; and a sensor which detects the position of said swingable lever.

26. The feeding system according to claim 25, wherein said top sensor is arranged to output a first signal indicating that said lever member is in said erect position and a second signal indicating that said lever member is in said retracted position.

* * * * *